US005944258A

United States Patent [19]

Chih

[11] Patent Number: 5,944,258

[45] Date of Patent: Aug. 31, 1999

[54] SPRAY GUN WITH A STRUCTURE THAT ALLOWS EJECTION OF A MIXTURE OF WATER

[76] Inventor: I-Shun Chih, No. 5, Tyan Yang Lane, Lu Kang Chen, Chang Hua County, Taiwan

[21] Appl. No.: 08/975,247

[22] Filed: Nov. 21, 1997

[51] Int. Cl.[6] ..... B05B 7/30; B05B 7/12; B05B 9/01

[52] U.S. Cl. ..... 239/318; 239/413; 239/526

[58] Field of Search ..... 239/302, 310, 239/315, 316, 318, 407, 413, 569, 581.1, 525, 526

[56] References Cited

U.S. PATENT DOCUMENTS

| | | | |
|---|---|---|---|
| 2,525,757 | 10/1950 | Albertson | 239/318 X |
| 2,616,660 | 11/1952 | Morehouse | 239/318 X |
| 2,908,445 | 10/1959 | Schwartz | 239/315 X |
| 3,113,725 | 12/1963 | Packard et al. | 239/318 |
| 3,863,843 | 2/1975 | Hechler, IV | 239/318 |

*Primary Examiner*—Lesley D. Morris
*Attorney, Agent, or Firm*—Bacon & Thomas

[57] ABSTRACT

A spray gun structure that may be controlled to eject water only or a mixture of water and detergent including a handle, a lever, a connecting body, a gun body, a detergent receiving tank, a securing screw sleeve, a retractable connector, and a nozzle. The lever is provided at a bottom portion of the handle for control of water intake. The connecting body is located at a top portion of the handle and extending forwardly and has a water channel a rear end of which is connected to a water conduit inside the lever. The gun body is connected to a rear portion of the connecting body and having a water channel which communicates with the water conduit of the connecting body such that, after the connecting body and the gun body are assembled, the detergent receiving tank may be mounted on a periphery of the assembly. The securing screw sleeve engages threads at a rear end of the gun body. The retractable connector has a hollow interior and an outer periphery fitted in the water channel of the gun body. The nozzle is connected to a rear end of the retractable connector such that it may slidably displace a suitable distance.

1 Claim, 7 Drawing Sheets

FIG 6-A 131
151
11
1111
16
18
113
12
17
162
13
131

SPRAY GUN WITH A STRUCTURE THAT ALLOWS EJECTION OF A MIXTURE OF WATER

BACKGROUND OF THE INVENTION (a) Field of the Invention

The present invention relates generally to a spray gun structure. More particularly, the present invention is directed to a spray gun that may be used to eject water only or a mixture of water and detergent.

(b) Description of the Prior Art

With conventional spray gun structures, as that shown in FIG. 1, the spray gun essentially comprises a gun body 2 with an interior defining a water passage 22, a handle 21 at a bottom portion of the gun body 2, a valve rod 3 extending from a rear end of a top portion of the gun body 2 into the water passage at the top portion of the gun body 2, a lever 4 pivotally connected to a rear end of the valve rod 3 so that the valve rod 3 may be retractably controlled to allow or cut off flow of water in the interior of the gun body 2, and a nozzle 5 (a conventional structure and will not be described in detail herein) that may be adjusted to vary the pattern of sprayed water. After assembly of these components, the lever 4 may control the stroke of the valve rod 3 due to linking-up movement, thereby achieving control of the amount of ejected water when water passes from the water passage 22 inside the handle 21 at the bottom portion of the gun body 2 to the interior of the gun body 2 and out through the nozzle 5. The structure and operation of such conventional spray guns are not described in further detail herein as they are well known in the art.

Such conventional spray guns are generally used in gardening, car washing and household cleaning. In car washing, the user usually ejects liquid detergent on the car to clean the car before washing away the detergent and dirt with clean water. Since the conventional spray gun can only eject water and control the amount of ejected water, the user has to use a separate means to spray detergent onto the car.

Reference is made to FIGS. 2, 3, and 4, which show a spray gun structure directed to providing the dual functions of ejecting water only or a mixture of detergent and water, as disclosed in the inventor's co-pending application. That spray gun structure is essentially comprised of a handle 8, a lever 9 provided at a bottom portion of the handle 8 for control of water intake, a connecting body 10 located at a top portion of the handle 8 and extending forwardly, the connecting body 10 having a water channel 101 a rear end of which is connected to a water conduit 91 inside the lever 9, a gun body 11 connected to a front portion of the connecting body 10, and a nozzle 12 pivotally connected to a rear end of the gun body 11 directly or by extension (not discussed herein as it is a conventional structure). The lever 9 is comprised of the water conduit 91, a control valve 92, a control lever 93, and a press plate 94. The water conduit 91 has a top end with an outer periphery insertably disposed in a rear end of the water channel 101 inside the connecting body 10, a water passage 911 which has a relatively small internal diameter at an upper section and a relatively large internal diameter at a bottom section, and a guide groove 912 disposed at one side of the bottom section thereof. The control valve 92 has a sealed top end and is provided with a water passage internally. The control valve controls the connection between its water passage and the water conduit 91. An annular guide rim 921 is provided at a middle section of an outer periphery thereof, for matching the guide groove 912 at the bottom portion of the water conduit 91. Gaskets 913 are respectively disposed at the top end of the control valve 92 and the periphery of the annular guide rim 921. A water outlet 914 is disposed between the annular guide rim 921 and the top end of the control valve 92. The control lever 93 has one end insertable into the annular guide rim 921 of the control valve 92 via the guide groove 912 of the water conduit 91 so that it may control the slidable displacement of the control valve 92. The press plate 94 may operate the control lever 93 to control the control valve to slidably displace. Such an arrangement controls the water current entering from the bottom end of the lever 9 into the water channel 101 inside the connecting body 10. But since such control of water current is well known in the art, it will not be discussed in detail herein. The present invention is characterized in that a detergent receiving tank 13 is mounted onto the periphery of the assembly of the connecting body 10 and the gun body 11. The detergent receiving tank 13 is provided with a filler hole 131 at an annular periphery thereof. The filler hole 131 has an internal taper 1311 at a top end thereof. A detergent release hole 102 is disposed at a rear end of the water channel 101 of the connecting body 10 such that a rear end of the release hole 102 may extend into the detergent receiving tank 13. The release hole 102 is further connecting to a detergent suction straw 14 that has a suction port 142 having a load 141 at a rear end thereof. There is further provided a control device comprising a cap 151 and a leakage-proof block 152. The cap 151 is fitted onto the filler hole 131. The cap 151 comprises an air vent 1511 centrally disposed at a top surface thereof, the top surface extending inwardly to form a positioning flange 1512 with positioning ribs 1513 disposed at an inner annular rim of the positioning flange 1512. Adjacent positioning ribs 1513 define an air path 1514. The leakage-proof block is made from elastic material with a top end thereof fitted among the positioning ribs 1513 of the cap 151 and a bottom end having a taper 1521 for matching the internal taper 1311 of the detergent filler hole 131. In this manner, entry of air via the air vent 1511 of the cap 151 through the air path 1514 into the detergent receiving tank 13 may be controlled.

With further reference to FIGS. 4 and 5, when it is desired to eject a mixture of water and detergent via the nozzle 12, it is only necessary to put the control valve 92 of the lever 9 into a water intake mode and turn open the cap slightly to allow entry of air into the detergent receiving tank 13 via the air vent 1511 and the air channel formed among the positioning ribs 1513 and through a clearance defined between the taper 1521 at the bottom end of the leakage-proof block 152 and the internal taper 1311 at the top surface of the filler hole 131. The supply of air enables the suction port 142 of the detergent suction straw 14 to suck up detergent by siphon action with the adjustment of the cap 151 to control the intake of air and hence the amount of detergent released so that the detergent suction straw 14 may keep in contact with the detergent any time to allow release of detergent via the release hole 102 to mix with the water. Therefore, whatever angle the spray gun of the invention is held at in use, the spray gun may be controlled to eject water only or a mixture of water and detergent. If it is desired to use the spray gun of the invention to eject water, it is only necessary to keep the control valve of the lever 9 at a water intake state and tighten the cap 151 so that the taper 1521 of the leakage-proof block 152 and the internal taper 1311 of the filler hole 131 are in a sealingly closed state, blocking out entry of air into the detergent receiving tank 13 so that detergent cannot be released via the release hole 102.

SUMMARY OF THE INVENTION

According to a first aspect of the invention, the spray gun comprises a handle, a lever, a connecting body, a gun body, a detergent receiving tank, a securing screw sleeve, a retractable connector, and a nozzle. The lever is provided at a bottom portion of the handle for control of water intake. The connecting body is located at a top portion of the handle and extending forwardly and has a water channel a rear end of which is connected to a water conduit inside the lever. The gun body is connected to a rear portion of the connecting body and having a water channel which communicates with the water conduit of the connecting body such that, after the connecting body and the gun body are assembled, the detergent receiving tank may be mounted on a periphery of the assembly. The securing screw sleeve engage threads at a rear end of the gun body. The retractable connector has a hollow interior and an outer periphery fitted in the water channel of the gun body. The nozzle is connected to a rear end of the retractable connector 16 such that it may slidably displace a suitable distance. The present invention is characterized in that an upper end and a lower end of a front end of the retractable connector are configured to be respective guide grooves communicating with the hollow interior of the retractable connector. A recess is formed at where the rear end of the gun body couples to the securing screw sleeve and in the direction of the connecting body. A pair of guide rails are oppositely disposed at upper and lower peripheries of an interior of the water channel for matching the guide grooves of the retractable connector. The recess is provided with a notch at an upper side thereof. Below a bottom rim of the recess and at the detergent receiving tank is provided a through hole at the same side of the notch, the through hole communicating with the detergent receiving tank. A trigger switch is fitted into the recess. The trigger switch has a hollow interior for insertion therein the retractable connector, and a water detent ring, a groove and an oblique groove at a lower rim thereof, the detent ring being held in the groove, and the oblique groove communicating with the hollow interior of the trigger switch.

According to a second aspect of the present invention, the guide grooves at the upper and lower ends of the front end of the retractable connector that may communicate with the hollow interior of the retractable connector match the recess and the pair of guide rails, so that the entire nozzle may retractably and slidably displace and may be retracted into the water channel of the gun body. Besides, the spray holes at the front end of the nozzle may be maintained at a specific direction during retractable operation of the nozzle.

BRIEF DESCRIPTION OF THE DRAWINGS

The foregoing and other features and advantages of the present invention will be more clearly understood from the following detailed description and the accompanying drawings, in which.

FIG. 6A is an enlarged schematic view of the trigger switch of the present invention;

DETAILED DESCRIPTION OF THE PREFERRED EMBODIMENT

Figure 1:
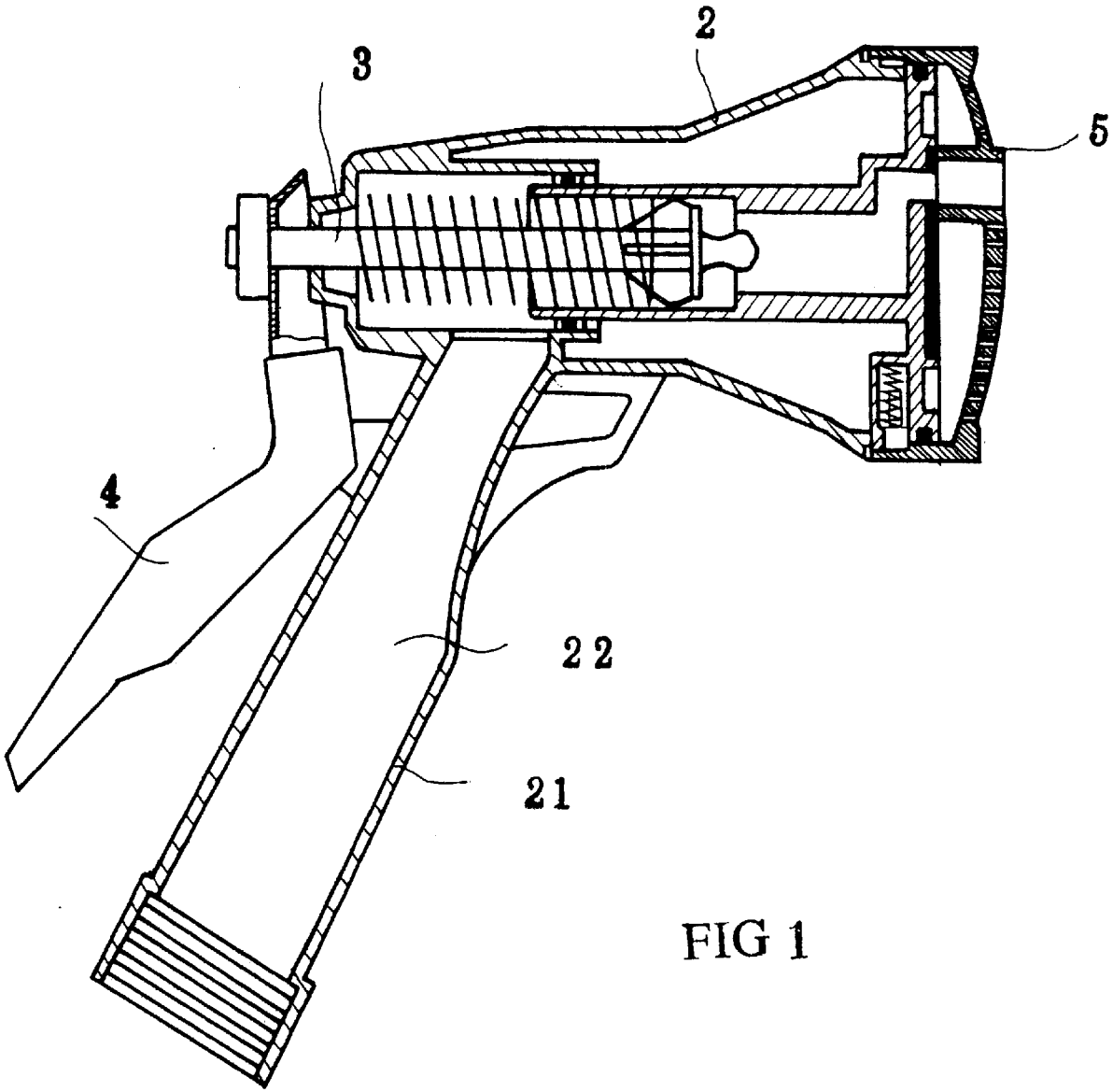
FIG. 1 is a schematic sectional assembled view of a prior spray gun structure.
Figure 2:
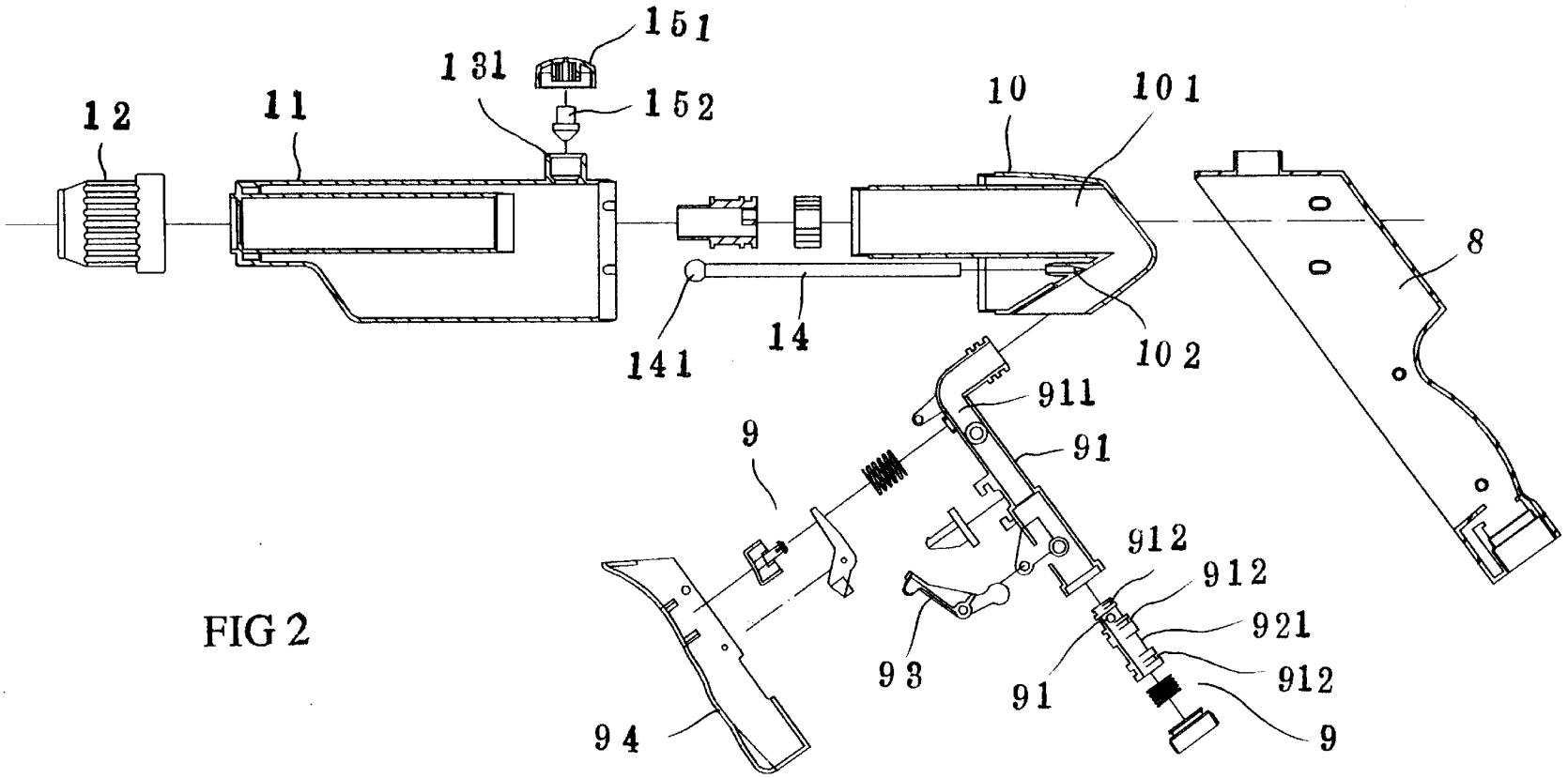
FIG. 2 is a structural exploded view of the spray gun disclosed in the inventor's co-pending application.
Figure 3:
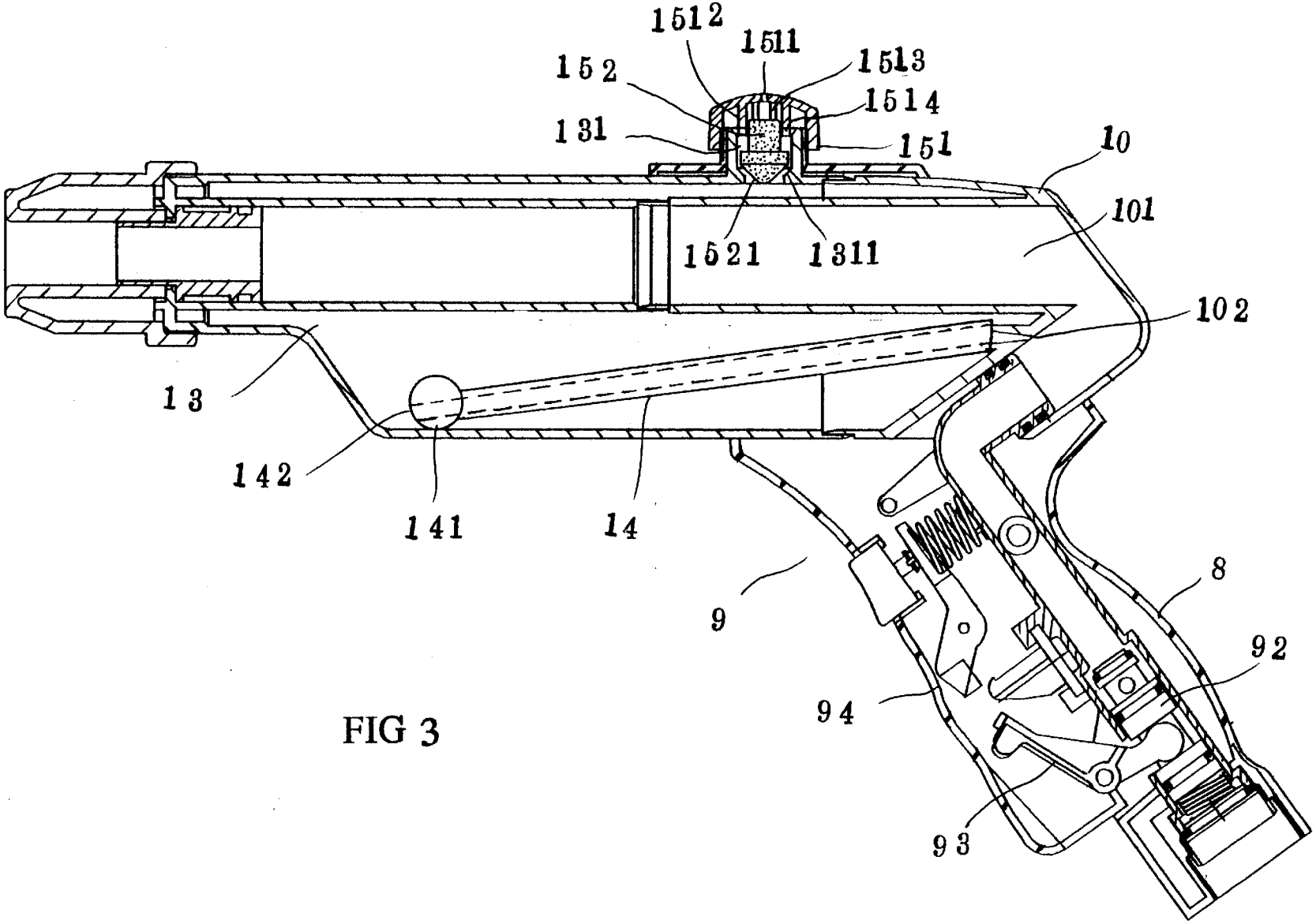
FIG. 3 is a schematic sectional assembled view of the spray gun shown in FIG. 2, showing the detergent mixing with the water in the spray gun.
Figure 4:
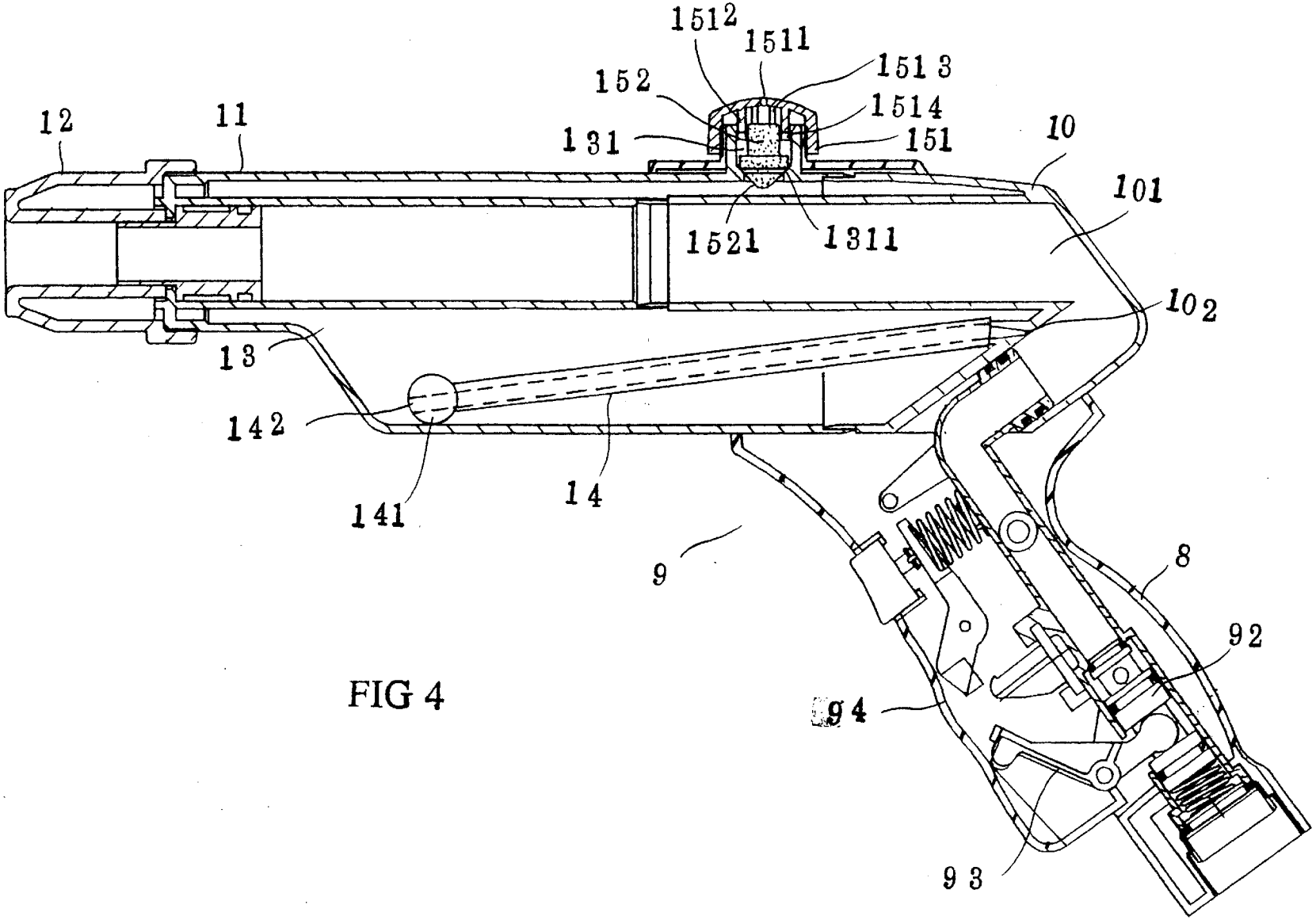
FIG. 4 is another schematic sectional assembled view of the spray gun shown in FIG. 2, showing the blocking of release of detergent into the water.
Figure 5:
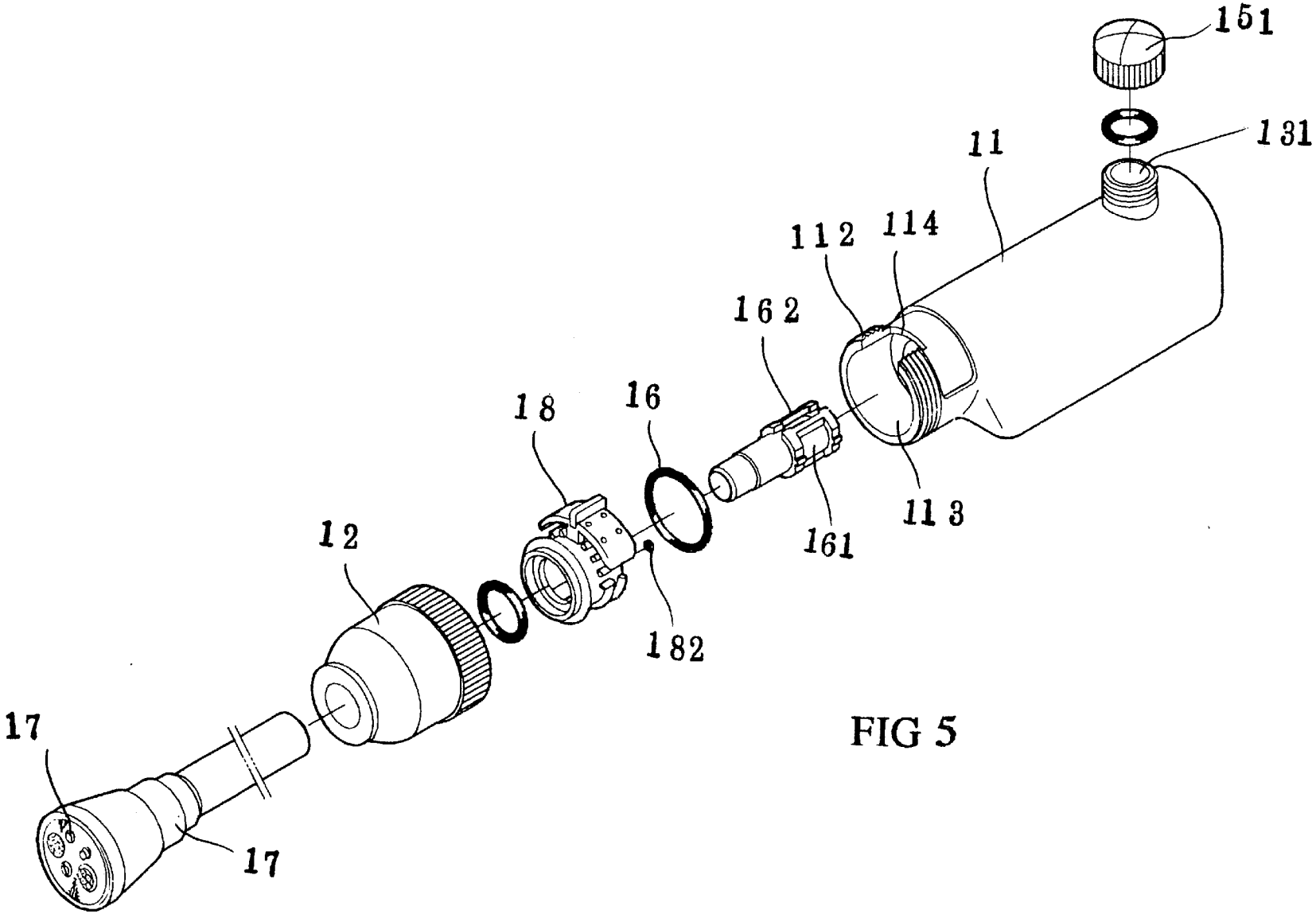
FIG. 5 is a perspective exploded view of the structure of the spray gun of the present invention.
Figure 6:
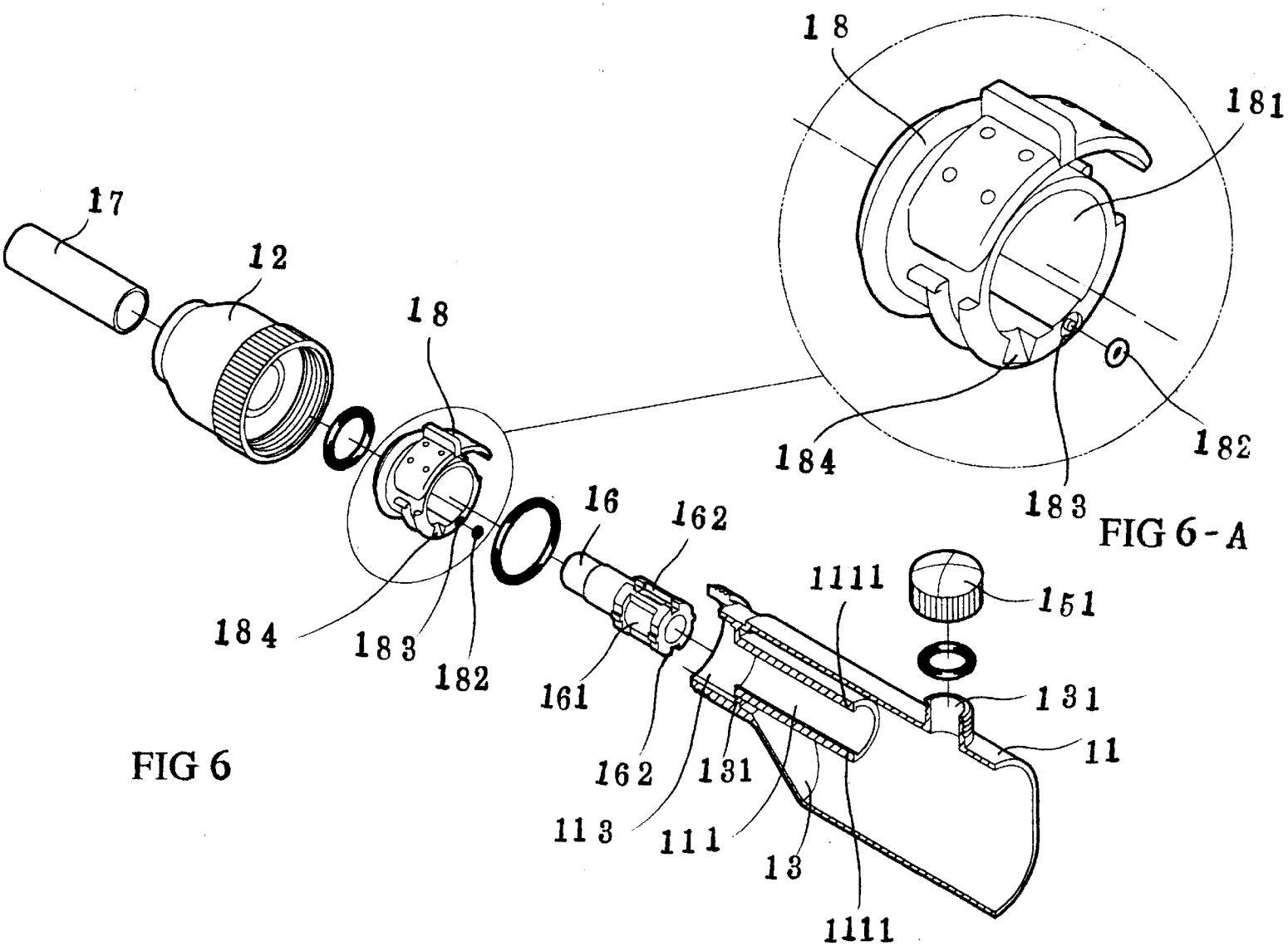
FIG. 6 is a perspective sectional exploded view of the present invention taken from a different angle.

With reference to FIGS. 2, 5, 6, 6A, 7, 8, 9 and 10, the present invention essentially comprises a handle 8, a lever 9 provided at a bottom portion of the handle 8 for control of water intake, a connecting body 10 located at a top portion of the handle 8 and extending forwardly, the connecting body 10 having a water channel 101 a rear end of which is connected to a water conduit 91 inside the lever 9, a gun body 11 connected to a rear portion of the connecting body 10 and having a water channel 111 which communicates with the water conduit 101 of the connecting body 10 such that, after the connecting body 10 and the gun body 11 are assembled, a detergent receiving tank 13 may be mounted on a periphery of the assembly, a securing screw sleeve 12 engaging threads 112 at a rear end of the gun body 11, a retractable connector 16 with a hollow interior 161 and having an outer periphery fitted in the water channel 111 of the gun body 11, and a nozzle 17 connected to a rear end of the retractable connector 16 such that it may slidably displace a suitable distance. The present invention is characterized in that an upper end and a lower end of a front end of the retractable connector 16 are configured to be respective guide grooves 162 communicating with the hollow interior 161; a recess 113 is formed at where the rear end of the gun body 11 couples to the securing screw sleeve 12 and in the direction of the connecting body 10; and a pair of guide rails 1111 are oppositely disposed at upper and lower peripheries of an interior of the water channel 111 for matching the guide grooves 162 of the retractable connector 16 so that the nozzle 17 may retractably and slidably displace. When the spray gun is assembled or not in use, the nozzle 17 may be retracted into the water channel 111 of the gun body 11. Besides, when the nozzle 17 connected to the rear end of the retractable connector 16 is retractably operated, spray holes 171 at a front end of the nozzle 17 may be maintained at a specific direction (please see FIGS. 5 and 10). The recess 113 is provided with a notch 114 at an upper side thereof. Below a bottom rim of the recess 113 and at the detergent receiving tank 13 is provided a through hole 131 at the same side of the notch 113, the through hole 131 communicating with detergent receiving tank 13. A trigger switch 18 (see FIG. 6A) is fitted into the recess 113. The trigger switch 18 has a hollow interior 181 for insertion therein the retractable connector 16, and a water detent ring 182, a groove 183 and an oblique groove 184 at a lower rim thereof, the detent ring 182 being held in the groove 183, and the oblique groove 184 communicating with its hollow interior 181.

Figures 7, 8, 9, 10:
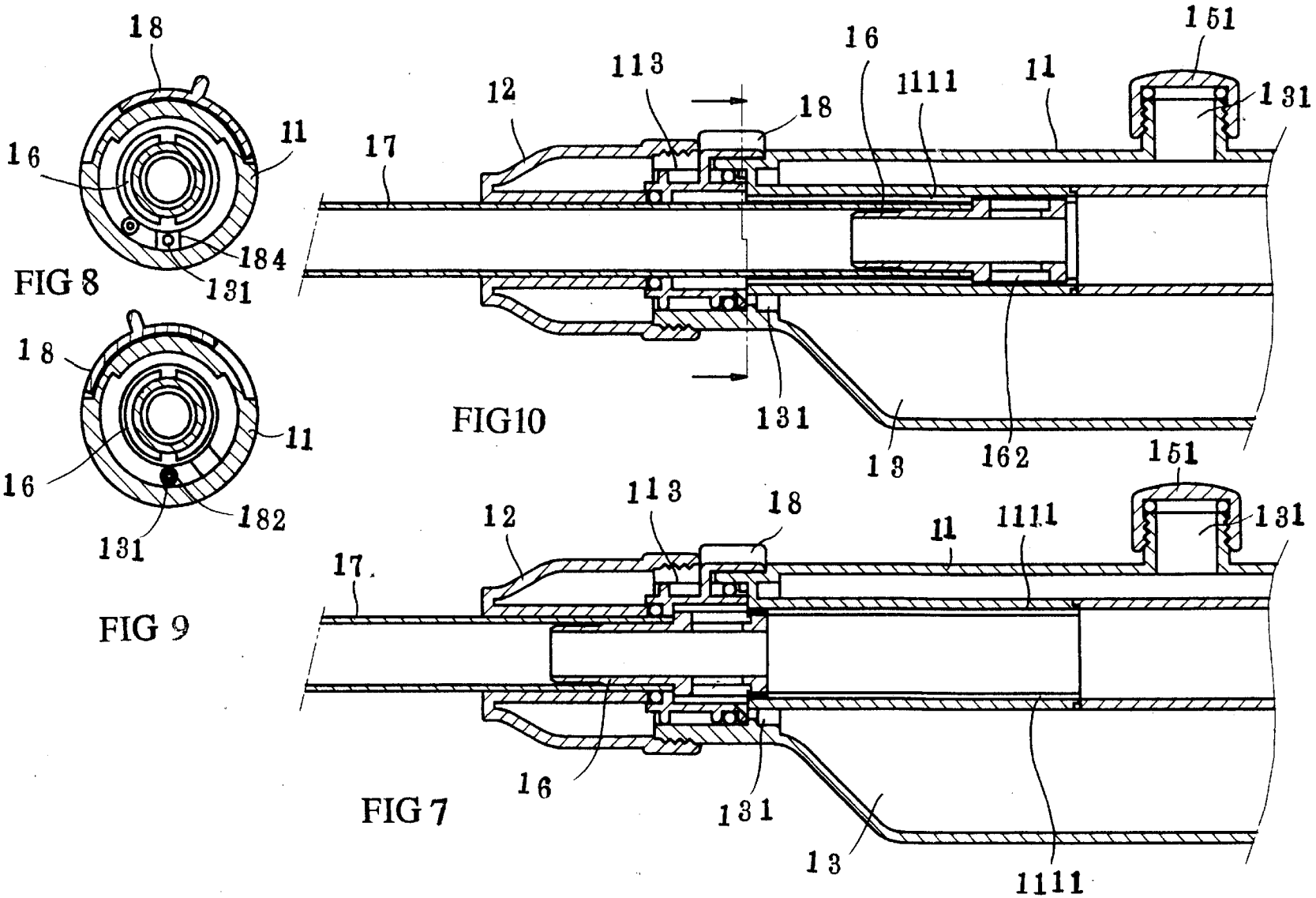
FIG. 7 is a schematic sectional assembled view of the present invention.
FIG. 8 is a schematic sectional assembled view of the present invention, showing the oblique groove at the lower rim of the trigger switch communicates with the through hole that communicates with the detergent receiving tank.
FIG. 9 is a schematic sectional assembled view of the present invention, showing the water detent ring cooperates with the through hole to block release of detergent from the detergent receiving tank.
FIG. 10 is a schematic sectional assembled view of the present invention.

Referring to FIGS. 7, 8 and 9 showing the assembled spray gun, when it is desired to eject a mixture of water and detergent via the nozzle 17 connected to the rear end of the gun body 11, the user may manipulate the trigger switch 18 so that the oblique groove 184 communicates with the through hole 131 communicating with the detergent receiving tank 13. Due to the current of water passing through the water channel and passage inside the spray gun, a siphon action is produced at the through hole 131 so that detergent flows via the through hole 131 past the oblique groove 184 and the guide groove 162 into the retractable connector 16, thus achieving control of release of detergent via the through hole 131 to mix with water in the spray gun (as shown in FIG. 8). On the contrary, when it is desirable to eject water only, it is only necessary to manipulate the trigger switch 18 so that the water detent ring 18 at the lower rim of the trigger switch 18 aligns with the through hole 13 (as shown in FIG. 9), detergent cannot be released through the through hole 131 so that only water is ejected from the nozzle 17.

In summary, the spray gun of the invention provides improved functions and, in particular, enables the nozzle to be retractable. Furthermore, the user may effectively control the spray gun to eject water only or a mixture of water and detergent.

Although the present invention has been illustrated and described with reference to the preferred embodiment thereof, it should be understood that it is in no way limited to the details of such embodiment but is capable of numerous modifications within the scope of the appended claims.

What is claimed is:

1. A spray gun structure, comprising a handle; a lever provided at a bottom portion of said handle for control of water intake; a connecting body located at a top portion of said handle and extending forwardly, said connecting body having a water channel a rear end of which is connected to a water conduit inside said lever; a gun body connected to a rear portion of said connecting body and having a water channel which communicates with said water conduit of said connecting body such that, after said connecting body and said gun body are assembled, a detergent receiving tank may be mounted on a periphery of the assembly; a securing screw sleeve engaging threads at a rear end of said gun body; a retractable connector with a hollow interior and having an outer periphery fitted in said water channel of said gun body; and a nozzle connected to a rear end of said retractable connector such that it may slidably displace a suitable distance, wherein said retractable connector has a front end with an upper end and a lower end configured to be respective guide grooves communicating with said hollow interior thereof; a recess is formed at where the rear end of said gun body couples to said securing screw sleeve and in the direction of said connecting body; and a pair of guide rails are oppositely disposed at upper and lower peripheries of an interior of said water channel for matching said guide grooves of said retractable connector, said recess being provided with a notch at an upper side thereof, and a through hole being disposed at said detergent receiving tank below a bottom rim of said recess at the same side of said notch, said through hole communicating with said detergent receiving tank, a trigger switch being fitted into said recess, said trigger switch having a hollow interior for insertion therein said retractable connector, and a water detent ring, a groove and an oblique groove at a lower rim thereof, said detent ring being held in said groove, and said oblique groove communicating with said hollow interior of said trigger switch, thereby said nozzle may be retracted when the spray gun is not in use and said trigger switch may be manipulated to effectively control the spray gun to eject water only or to eject a mixture of water and detergent.

* * * * *